US005819327A

United States Patent [19]

Miller

[11] Patent Number: 5,819,327

[45] Date of Patent: Oct. 13, 1998

[54] AUTOMATIC TOILET SEAT LOWERING APPARATUS

[76] Inventor: Rex L. Miller, 5234 Pleasant Valley Rd., Oakdale, Calif. 95361

[21] Appl. No.: 789,953

[22] Filed: Jan. 30, 1997

[51] Int. Cl.[6] ..... A47K 13/10

[52] U.S. Cl. ..... 4/246.1; 4/248

[58] Field of Search ..... 4/246.1, 246.2, 4/246.3, 246.4, 246.5, 248

[56] References Cited

U.S. PATENT DOCUMENTS

| | | | |
|---|---|---|---|
| 2,200,687 | 5/1940 | Bercot | 4/246.1 |
| 3,404,411 | 10/1968 | Newkirk | 4/246.1 |
| 5,153,946 | 10/1992 | Yoke et al. | 4/248 |
| 5,388,281 | 2/1995 | Wiklund et al. | 4/248 |

*Primary Examiner*—Robert M. Fetsuga
*Attorney, Agent, or Firm*—John P. O'Banion

[57] ABSTRACT

An automatic toilet seat closing apparatus, particularly adapted for use with a toilet seat is described. The apparatus will automatically lower a toilet seat that has been rotated to a raised position after a time interval determined by the extent to which a wind-up motor is wound. The mechanism is simply constructed and preferably mounted on the bottom surface of a standard toilet seat, so that it provides a clean, neat appearance which is aesthetically pleasing and does not interfere with the cleaning or maintenance of the toilet fixture. The apparatus includes an energy storage device, a locking mechanism, an override mechanism, and a wind-up motor which serves both as a timer and a triggering device. The energy storage device includes springs which store energy transferred to it by a user when a user raises the toilet seat, for use in urging the toilet seat back to a lowered position after the time period clocked by the wind-up motor has elapsed. The springs in the energy storage device also dampen the descent of the toilet seat so that the seat does not close with a loud noise or damaging the seat or the toilet bowl. The locking mechanism releasably but temporarily locks the toilet seat in a raised position until the wind-up motor triggers the release of the lock. The override mechanism allows the automatic closing of the toilet seat to be overridden, thereby allowing a user to lock the toilet seat in the raised position indefinitely. The override mechanism also allows the timed closure of the seat to be overridden such that a user may return the seat to a lowered position before the time period has elapsed. The advantages include a simpler economic construction, a neat appearance, and a mechanism that allows the seat to be locked in a raised position to facilitate cleaning and maintenance.

14 Claims, 7 Drawing Sheets

AUTOMATIC TOILET SEAT LOWERING APPARATUS

BACKGROUND OF THE INVENTION

1. Field of the Invention

This invention pertains generally to devices and methods for closing or lowering toilet seats and covers, and more particularly to an automatic toilet seat lowering apparatus that lowers the toilet seat after a predetermined time period has elapsed, which can be locked in an open position to override the automatic lowering of the seat, and which can be used with conventional toilets.

2. Description of the Background Art

The failure by persons to lower toilet seats after use can often result in delay and difficulty to subsequent users. Particularly, men frequently use toilets while the seat is in a raised position while women generally use toilets while the seat is in the lowered position, and when a man inadvertently leaves the toilet seat in the raised position, a woman who later uses the toilet and must lower the seat, may experience inconvenience and discomfort. This problem is exacerbated at night and when a bathroom is dark, since the user may be tired and poor visibility due to the darkness makes it difficult to ascertain whether or not the toilet seat is raised or lowered.

Various devices and methods that have been developed provide for automatic return of a toilet seat to the lowered position. Previous devices, however, have proven deficient for a number of reasons. Many seat lowering arrangements are inconvenient to install and cannot easily be retrofitted to conventional toilets and toilet seats. Another common problem is that the seat lowering devices tend to be bulky and unattractive. A further problem is that such devices tend to be difficult to clean and disinfect. Still another problem is that many devices, once installed, cannot be prevented from automatic closing the toilet seat, resulting in inconvenience and interference with toilet cleaning. Yet another drawback is that previously used toilet seat closing devices do not always provide for damping during closure so that the toilet seat impacts the toilet with a loud noise upon closure.

More aesthetic and compact mechanisms for damping the closure of a toilet seat or automatically closing and damping the closure of a toilet seat have also been invented. One such mechanism is described in U.S. Pat. No. 5,153,946 issued to Yoke et al. on Oct. 13, 1992. Yoke et. al. describes an apparatus that includes a control mechanism engageable with a toilet bowl lid for locking the lid in the open position after the lid is pivoted to the open position, and a timer mechanism for actuating the control mechanism to release the lid from the open position after a predetermined time interval. The timer mechanism is suspended while at least a predetermined weight is applied to the seat in the lowered position. The apparatus further includes a damper mechanism to retard the descent of the lid after the lid is urged to the closed position by the action of a coil spring when the predetermined time interval has expired.

A shortcoming of this apparatus is that although it is relatively unobtrusive and aesthetic in its appearance, it does not include an override of the timer mechanism to maintain an open position of a toilet seat. When cleaning a toilet, it is most convenient when the toilet seat and lid maintain an open position which allows the cleaner to easily manipulate cleaning agents and devices within the toilet cavity. If a toilet seat closes during such a procedure, it can be frustrating, could cause one cleaning the toilet to spill a cleaning agent, or could injure the head of one cleaning the toilet.

Another shortcoming of this invention and others utilizing hydraulic dampening is that such a system requires precision machining to create fluid tight reservoirs, thereby increasing cost and reducing marketability of such devices.

Accordingly, there is a need for an automatic toilet seat lowering apparatus which is compact and unobtrusive, which is easily installed on conventional toilet seats, which is easy to clean, which provides damping to prevent noise and damage from seat closure, which can be locked in the open position to temporarily prevent automatic closing, and which is relatively simple to manufacture and does not require precision machining during manufacture. The present invention satisfies those needs, as well as others, and generally overcomes the deficiencies found in the background art.

SUMMARY OF THE INVENTION

The present invention is an automatic toilet seat lowering apparatus which is compact, can be quickly and easily installed on conventional toilet seats, and includes a mechanism that overrides the automatic function to lock the toilet seat in an open position, and avoids the need for fluid tight reservoirs and the need for precision machining.

In general terms, the invention comprises a mounting plate which couples to the rim of a standard toilet bowl, a pair of cocking arms pivotally mounted on the mounting element, a housing which couples to the bottom surface of a conventional toilet seat, a pair of tracks in the housing which each slidably hold a latch block. The cocking arms are attached to the latch blocks which are slidably mounted in each track. Means for holding the latch blocks in an open position wherein the toilet seat and attached housing are raised, means for timed or automatic releasing of the latch blocks from the open position after a predetermined time period has elapsed, and lock means for preventing release of the latch blocks from the open position are also provided with the invention.

By way of example, and not of limitation, the mounting element preferably comprises a generally flat, "U"-shaped member with first and second spaced apart forward-pointing legs. A clamp or bracket is provided on each forward leg which engages and holds the rim of a toilet bowl. First and second cocking arms are pivotally mounted to the first and second forward legs respectively. Holes or openings are included adjacent a back edge of the mounting element to accommodate standard toilet seat and toilet lid coupling hardware.

The housing of the apparatus is preferably a flat, generally oval-shaped member which matches the structure and configuration of a standard toilet seat. The housing is attached to the bottom surface of the toilet seat by standard means. The housing preferably comprises a tray-like bottom portion with inner and outer side walls, and a top portion which joins to the bottom portion and defines a hollow interior within the housing between the top and bottom portions.

First and second spaced apart, elongated, longitudinal channels or tracks are included in the housing, with the tracks slidably receiving first and second latch blocks respectively. First and second slots on the bottom surface of the housing communicate with the first and second tracks and latch blocks respectively. The first and second cocking arms on the mounting element are pivotally coupled respectively to the first and second latch blocks through the first and second slots, so that when the toilet seat and attached housing are lowered from the open position or raised from the closed position, the latch blocks slide within the tracks as the attached cocking arms pivot on the mounting element. In the open position, the latch blocks slide towards a locking end of the tracks, and in the closed position, the latch blocks slide towards the front end of the tracks.

The means for holding the latch blocks in the open position preferably comprises a latch assembly with first and second movable latches included adjacent the locking ends of the first and second tracks respectively. A setting block is slidably mounted in one of the tracks, with the setting block being mechanically interfaced with the first and second latches so that, as the setting block slides from the back end of the track towards a front end of the track upon lowering of the toilet seat, the latches move from an unlocked position to a locking position. In the locked position, the latches extend into the tracks and into the paths of the sliding latch blocks, while in the unlocked position the latches are withdrawn from the tracks so that the latch blocks can slide freely therein. The latches are biased towards the locked position. The latch blocks include slots which engage the latches.

The latch assembly includes a ratchet and pawl mechanism which retains or locks the latches in the locking position until the ratchet and pawl mechanism is tripped or released by the timed releasing means. The ratchet and pawl mechanism includes a spring loaded ratchet member pivotally mounted on the housing, and a spring loaded pawl member pivotally mounted on the housing which is positioned to releasibly engage the ratchet member while the latches are in the locking position. The ratchet member is mechanically interfaced with the latches and setting block and is biased towards the unlocked position. As the setting block slides from the back end to the front end of the track during the lowering of the toilet seat, the mechanically interfaced ratchet member pivots so that the pawl member engages and holds the ratchet member to retain or lock the latches in the locking position. When the pawl member is tripped, the pawl member releases the ratchet member to allow the latches to return to the unlocked position.

The means for automatic or timed releasing of the latch blocks from the open position after a predetermined time period has elapsed preferably comprises a wind-up motor or spring and a wind-up block that is slidably mounted in one of the tracks and which is mechanically interfaced with the wind-up motor. The wind-up motor is mechanically interfaced with the spring loaded pawl member of the latch assembly and trips the pawl member to disengage the pawl member from the latch member after a predetermined time period has elapsed.

Override means for preventing release of the latch blocks from the open position are preferably provided in the form of an override knob movably mounted on the housing and mechanically interfaced with the ratchet member and pawl member. When the override knob is moved to a release override position, the ratchet member and latches are held in the locking position. The override means is also preferably interfaced with the pawl member and can be moved to a lock override position which trips the pawl member and releases the latch body and latches.

The automatic toilet seat lowering apparatus comprising the invention is used by attaching the mounting element to a toilet bowl, and attaching the housing of the apparatus to the lower side of the toilet seat which is pivotally mounted on the toilet bowl. The cocking arms on the mounting element are attached to the corresponding latch blocks in the tracks of the housing. When the toilet seat and attached housing are lowered, the latch blocks slide forward within their respective tracks. As the latch blocks slide forward, the setting block and wind-up block are pushed forward within the tracks by the latch blocks. The setting block, which is mechanically interfaced with the latches and ratchet member, moves the latches and ratchet member into their locking positions as the setting block moves forward. When the ratchet member and latches reach the locking positions, the pawl member engages the ratchet member to hold the ratchet member and latches in the locking position. The wind-up block, which is mechanically interfaced with the wind-up motor, winds up a watch spring within the motor.

While the toilet seat is in the lowered or closed position, the latch blocks are positioned adjacent the front ends of the tracks, and the setting block and wind-up block are held at the front ends of the tracks by the latch blocks. The wind-up block, while forwardly positioned in the track, maintains a tension on the watch spring in the wind-up motor and prevents the wind-up motor from unwinding.

When the toilet seat and attached housing are raised or opened, the latch blocks slide within the tracks to the back end of the tracks, and the latches, which extend into the tracks while in the locking position, engage the slots in the latch blocks to hold or lock the latch blocks at the locking ends of the track, thus locking the toilet seat in the open position. Cam surfaces on the latch blocks and latches allow the latch blocks to slide over the latches so that the latches can engage the slots in the latch blocks.

As the latch blocks slide towards the locking ends of the tracks upon the raising or opening of the toilet seat, the setting block and wind-up block are released. When the wind-up block is released, the tension is removed from the watch spring is removed and the wind-up motor starts to run. After a predetermined time period has elapsed, the wind-up motor actuates the mechanically interfaced pawl member, causing the release of the ratchet member and unlocking of the latches. As the latches unlock, they are withdrawn from the tracks and release the latch blocks which slide forward in the tracks because of the bias created by the springs in the tracks, causing the toilet seat to automatically close. The springs within the tracks also create a damping force to prevent the toilet seat from slamming down against the toilet bowl rim upon closing. The override mechanism can be set to prevent the automatic closing of the toilet seat and retain the seat in the raised position. The override mechanism can subsequently be released to allow the toilet seat to close. The latch assembly, ratchet mechanism, wind-up motor and other moving parts except for the pivoting cocking arms are all internal to the housing of the apparatus so that the apparatus can be easily cleaned.

The timing of the actuation of the pawl member, and thus the timing of the unlocking of the latches and closing of the toilet seat, is controlled by the amount or degree to which the watch spring is wound, which can be adjusted as desired. As the toilet seat closes, the latch blocks again push the setting block and wind-up block forward, which again sets the latches and ratchet member in the locking position and winds up the motor. Thus, each time the toilet seat closes, the apparatus is automatically cocked to provide for automatic, timed lowering of the toilet seat when it is next raised.

An object of the invention is to provide an automatic toilet seat lowering apparatus which automatically lowers a raised toilet seat after a predetermined time period has elapsed after the raising of the toilet seat.

Another object of the invention is to provide an automatic toilet seat lowering apparatus which does not slam the toilet seat on the toilet bowl rim upon lowering or closing.

Another object of the invention is to provide an automatic toilet seat lowering apparatus which has smooth, easily cleaned external surfaces.

Another object of the invention is to provide an automatic toilet seat lowering apparatus wherein the time interval between the raising and automatic lowering of the toilet seat can be adjusted.

Another object of the invention is to provide an automatic toilet seat lowering apparatus which is compact and unobtrusive.

Another object of the invention is to provide an automatic toilet seat lowering apparatus which is easily installed on conventional toilet seats.

Another object of the invention is to provide an automatic toilet seat lowering apparatus which can be locked in the open position to prevent automatic closing.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus generally shown in FIG. 1 through FIG. 6. It will be appreciated that the apparatus may vary as to configuration and as to details of the parts without departing from the basic concepts as disclosed herein.

Figure 1A:
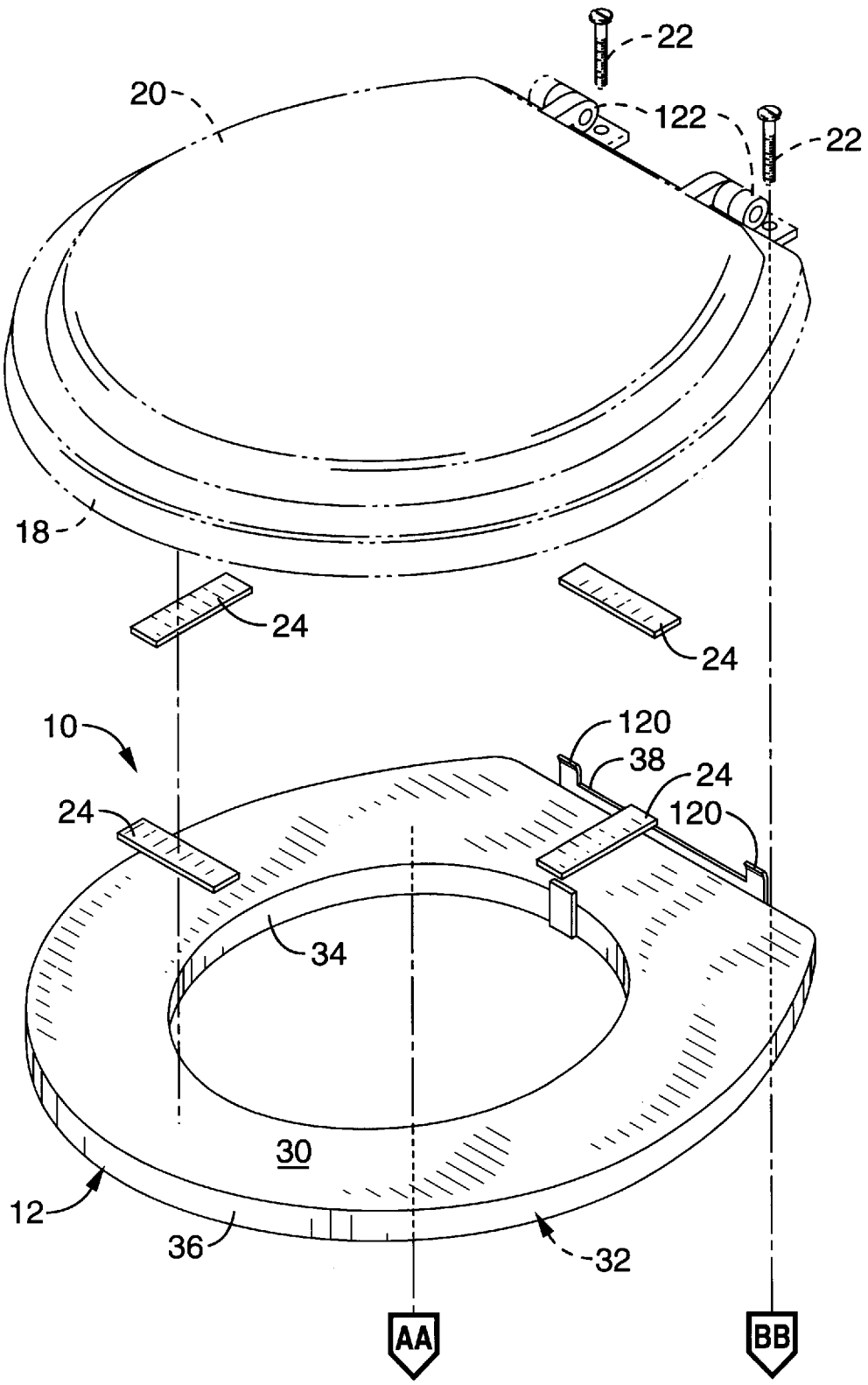
FIG. 1A and FIG. 1B are an exploded view of an automatic closing unit and associated mounting plate in accordance with the present invention shown in relation to a toilet seat and toilet bowl in phantom.
Figure 1B:
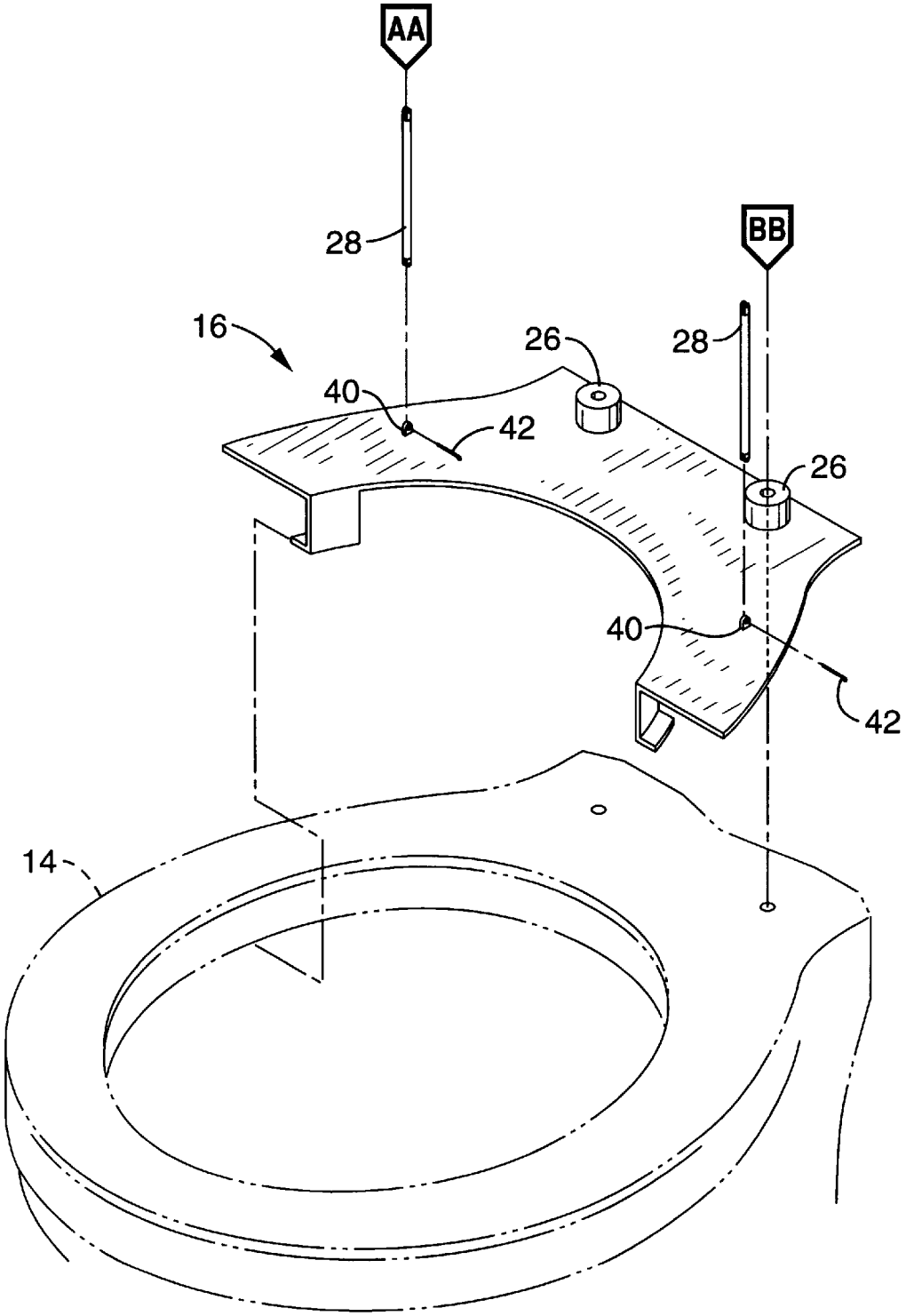
Figure 2:
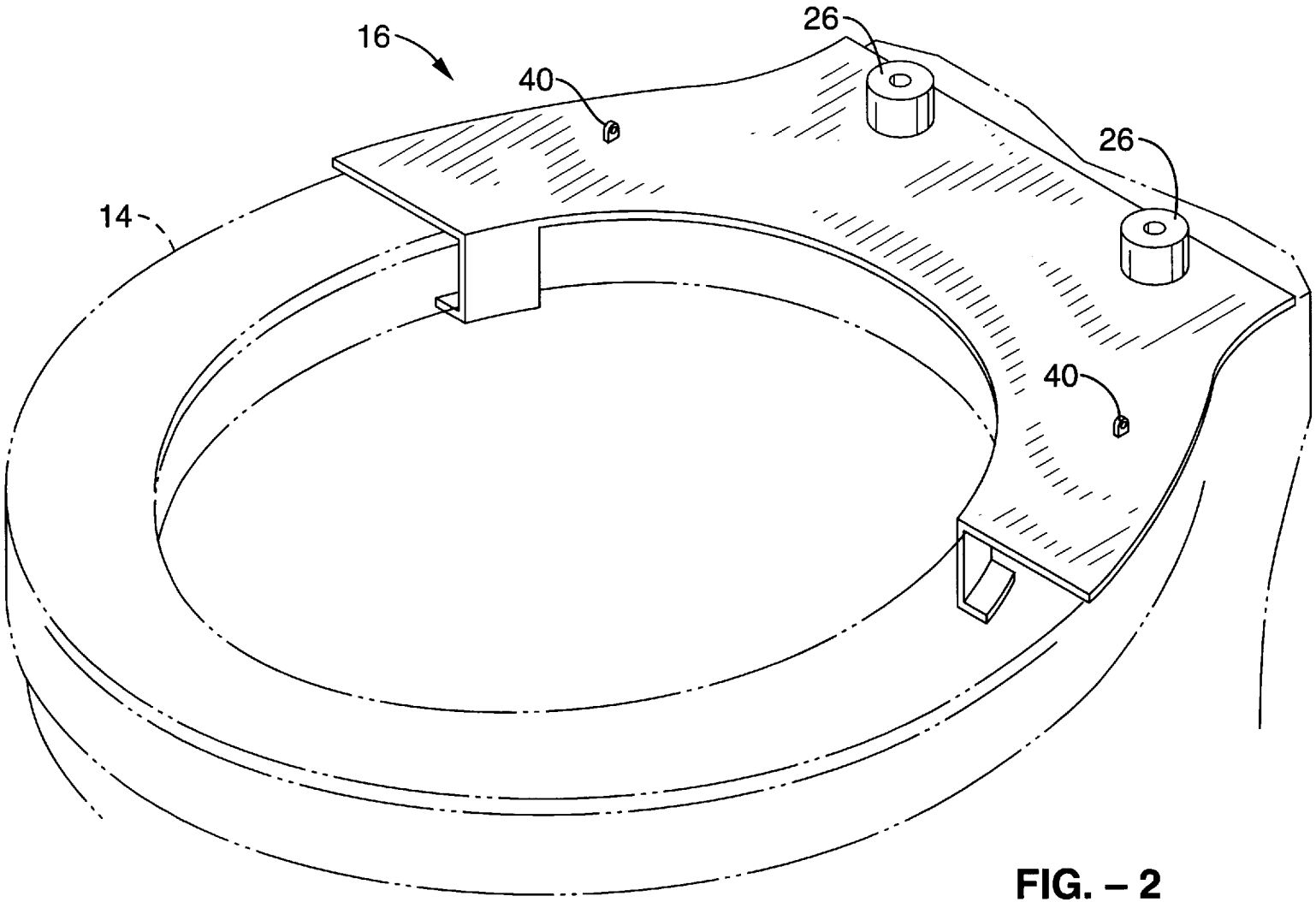
FIG. 2 is a side elevational view of the mounting plate properly installed on a toilet bowl.

Referring first to FIG. 1A, FIG. 1B and FIG. 2, a control unit 10 in accordance with the present invention for automatically lowering a toilet seat is generally shown. Control unit 10 generally includes a housing 12 which is mounted to a toilet bowl 14 using a mounting plate 16. A conventional toilet seat 18 and lid 20, as well as a mounting plate 16 in accordance with the invention, are secured to toilet bowl 14 just forward of the tank (not shown) using conventional anchor bolts 22. Housing 12 is secured to the bottom surface of toilet seat 18 by a permanent or temporary adhesive such as Velcro® strips 24. Mounting plate 16 includes shims 26 which maintain a gap between toilet seat 18 and toilet bowl 14 so that when control unit 10 is mounted to bottom surface of toilet seat 18, and toilet seat 18 is in the lowered position, toilet seat 18 is parallel with toilet bowl 14. Rotatably mounted to mounting plate 16 are a pair of cocking arms 28.

Housing 12 holds the majority of the components of control unit 10 and comprises an upper wall 30, a lower wall 32, an inner wall 34, an outer wall 36. A pair of cocking arms 28 extend through a slot in lower wall 32 of housing 12 and cooperate with various components of control unit 10 situated within housing 12. Housing 12 also includes an alignment plate 38 which helps to maintain proper alignment between control unit 10 and toilet seat 18.

Figure 3:
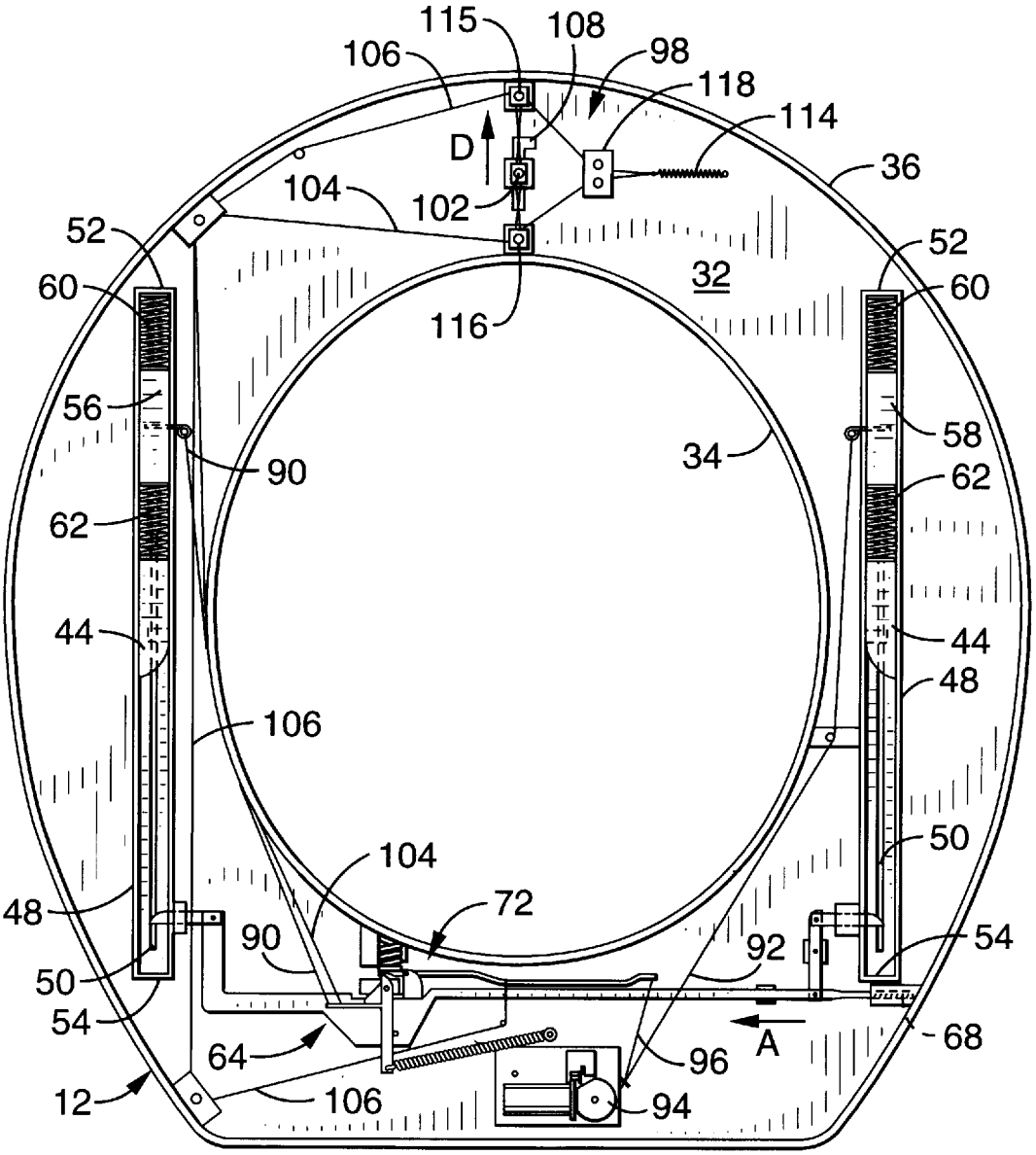
FIG. 3 is a top plan view of the lowering apparatus.
Figure 4:
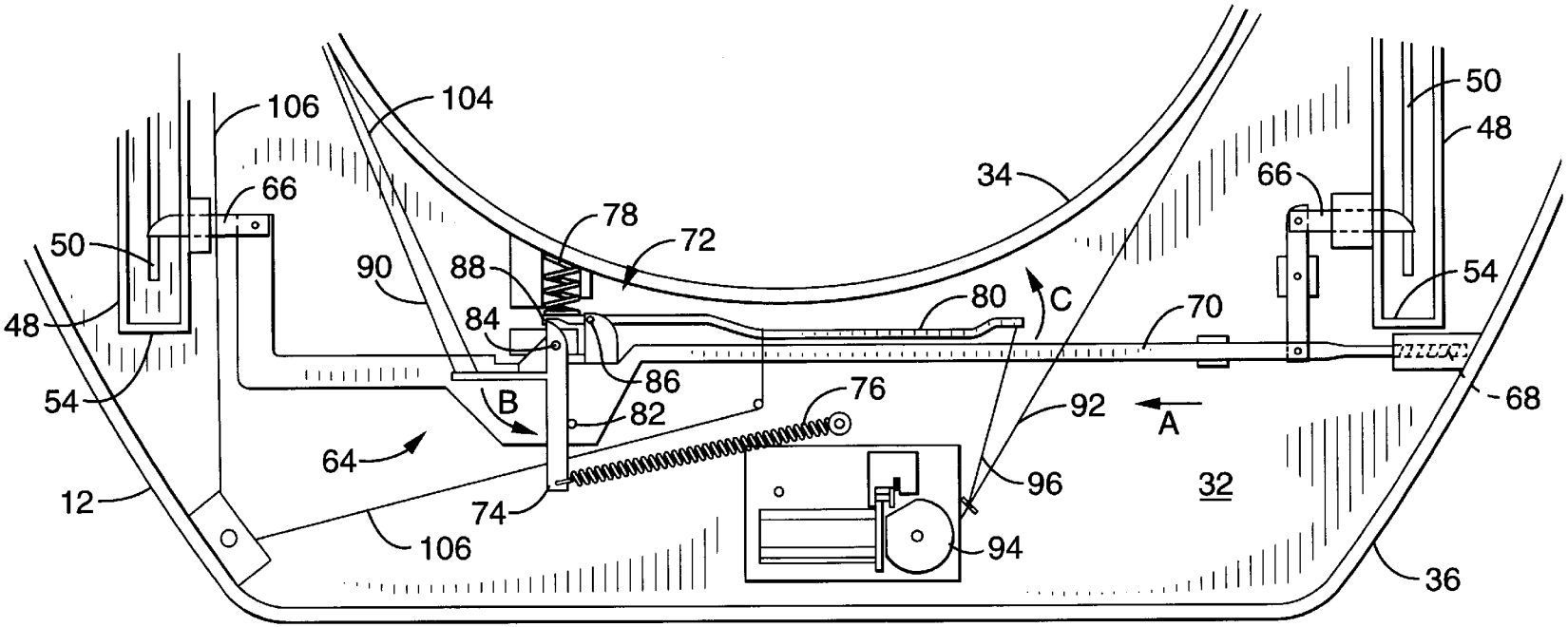
FIG. 4 is a top plan view of the rear portion of the lowering apparatus shown in FIG. 3.
Figure 5:
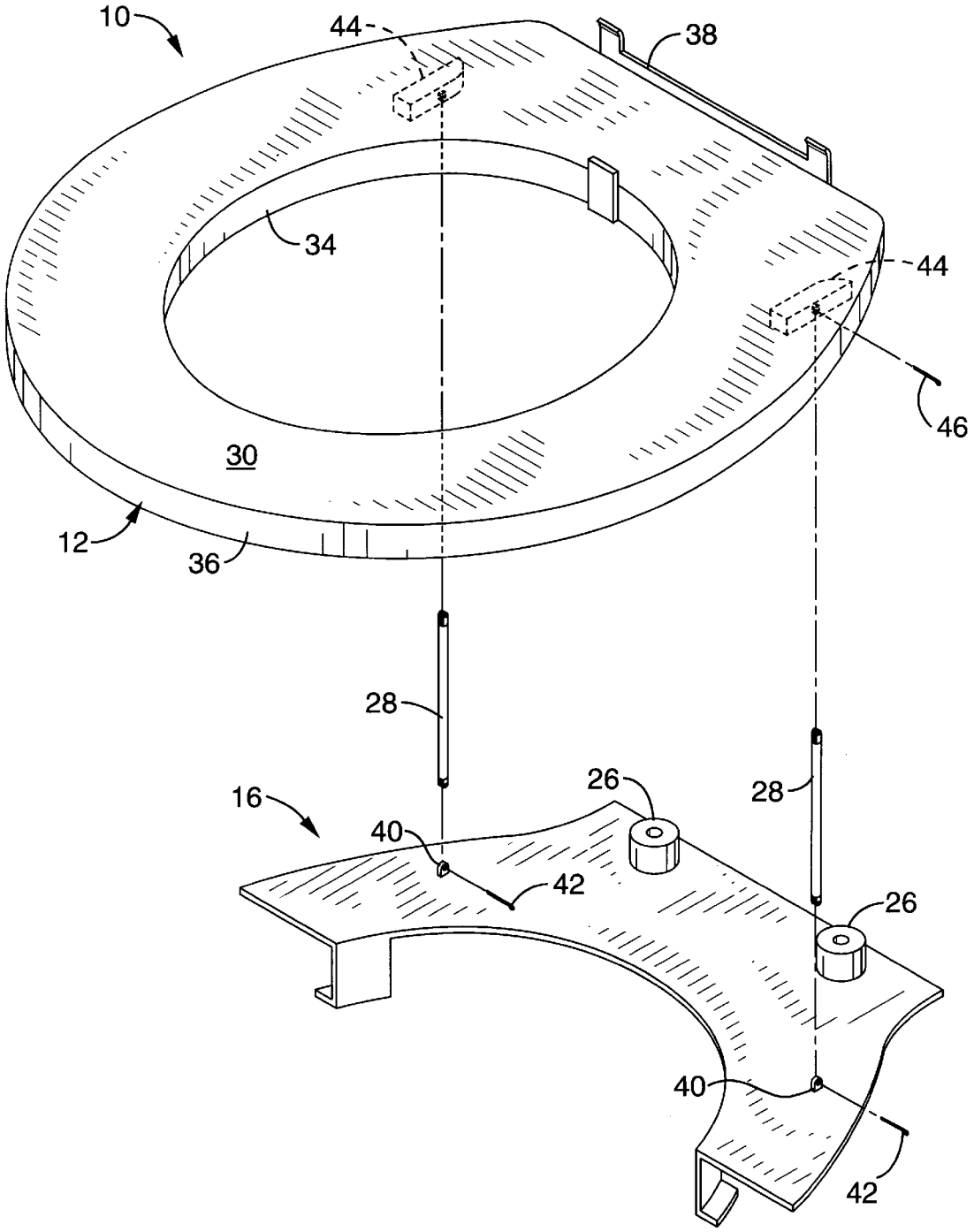
FIG. 5 is an exploded view of a toilet bowl and the lowering apparatus with the position of the latch blocks in phantom lines.

Referring also to FIG. 3 through FIG. 5, upper wall 30 of housing 12 is coupled to the bottom surface of seat 18. Lower wall 32 of housing 12 includes a pair of elongated slots 50 for receipt of corresponding portions of cocking arms 28. The lower ends of cocking arms 28 are mounted to mounting plates 16 by mounting eyes 40 and mounting pins 42. The upper end of cocking arms 28 are similarly mounted to latch blocks 44 with latch pins 46 as shown in FIG. 5.

Each latch block 44 moves slidably along a channel or track 48, which each track having a locking end 54 and a forward end 52. Also slidably mounted within tracks 48 are a setting block 56 and a wind-up block 58. Setting block 56 and wind-up block 58 are each mounted between a forward spring 60 and a rearward spring 62. The springs 60 and 62 are calibrated so that when the toilet seat 18 is lifted upward into a raised position, cocking arms 28 also rotate upward causing latch blocks 44 to slide toward the locking end 54 of tracks 48, thereby elongating the springs 60 and 62 past their equilibrium state. Because the springs 60 and 62 are elongated past their equilibrium state when toilet seat 18 is raised, toilet seat 18 is biased to rotate downward to a closed position. Conversely, when toilet seat 18 is lowered, cocking arms 28 urge latch blocks towards the forward ends 52 of tracks 48, thereby compressing springs 60 and 62 beyond their equilibrium state and providing a damping force to slow the lowering of the toilet seat 18 naturally caused by gravity.

Located generally at the locking end 54 of tracks 48 is a locking mechanism 64 that comprises a pair of latches 66 which are shaped and configured to engage latch blocks 44, a latch body 70, and a lock spring 68. Latch body 70 is slidably mounted in housing 12, moving between a locked position and an unlocked position. Lock spring 68 biases latch body 70 in direction along arrow A, towards a locked position where latches 66 are urged into the tracks 48 and into the paths of latch blocks 44. The locking position is shown in FIG. 3 and FIG. 4. When latch body 70 is moved in the opposite direction of arrow A, against the bias of lock spring 68 toward an unlocked position, latches 66 are withdrawn from tracks 48 and the paths of latch blocks 44.

Movement of the locking mechanism is controlled by a ratchet and pawl mechanism 72 which comprises a ratchet 74, ratchet spring 76, a pawl spring 78, and a pawl lever 80. Ratchet 74 is pivotally mounted by ratchet pin 84. Ratchet spring 76 biases ratchet in direction of arc B about ratchet pin 84. Ratchet 74 communicates with latch body 70 through latch pin 82 which is rigidly mounted by its lower end in latch body 70, and extends upwardly to ride along the edge of ratchet 74. Through the bias of ratchet 74 created by ratchet spring 76, latch body 70 is urged to an unlocked position, against the bias of latch body 70 that is created by lock spring 68. Pawl lever 80 is pivotally mounted by pawl pin 86. Pawl spring 78 biases pawl lever 80 towards an engaged position (shown) in direction of arc C. When in an engaged position, pawl lever 80 engages ratchet 74 with pawl tooth 88, thereby holding ratchet 74 against the bias created by ratchet spring 76, and allowing latch body 70 to maintain a locked position to which it is biased by lock spring 68. When pawl lever 80 is pivoted in direction opposite arc C, pawl tooth 88 releases ratchet 74, thereby allowing it to rotate toward its biased position, in direction of arc B, thereby urging latch body 70 toward an unlocked position.

Setting block 56 is attached to ratchet 74 by setting cable 90. Wind-up block 58 is attached to a spool on a conventional wind-up motor 94 by wind-up cable 92. Wind-up motor 94 is also attached with pawl lever 80 by release cable 96. When toilet seat 18 is in the lowered position, cocking arms 28 hold latch blocks 44 toward the forward end 52 of tracks 48, thereby compressing forward springs 60 and rearward springs 62, and holding setting block 56 and windup block 58 against the forward end 52 of tracks 48 as shown in FIG. 3. When toilet seat 18 moves to this position, setting block 56 creates sufficient tension in setting cable 90 to cause ratchet to rotate in opposite direction of arc B and engage pawl tooth 88, thereby allowing latch body 70 to move to a locked position to which it is biased. When toilet seat 18 moves to this position, wind-up block 58 creates sufficient tension in wind-up cable 92 to wind the wind-up motor 94. Because wind-up cable 92 and release cable 96 are wound in the same direction onto wind-up motor 94, slack is created in release cable 96 when toilet seat 18 is in the lowered position. While seat 18 is in the lowered position, wind-up motor 94 remains in a wound state.

When a user raises seat 18, cocking arms 28 pull latch blocks 44 to the locking ends 54 of tracks 48, thereby engaging latches 66 which thereby releasably but temporarily lock and hold latch blocks 44 at the locking end 54 of tracks 48 and thereby locking seat 18 in the upright position. When latch blocks 44 are pulled to the locking end 54 of tracks 48, setting block 56 is also pulled toward the locking end 54 of tracks 48 thereby removing tension from setting cable 90. Wind-up block 58 is similarly pulled towards the locking end 54 of track 48 and similarly relieves tension in wind-up cable 92. When tension is released from wind-up cable 92, wind-up motor 94 begins to unwind and continues to unwind until the predetermined time period elapses. As wind-up motor 94 reaches the end of the predetermined time period, wind-up motor 94 creates tension in release cable 96, urging pawl lever 80 to pivot in opposite direction of arc C, thereby releasing ratchet 74 from pawl tooth 88 and allowing ratchet to rotate in direction of arc B because of the bias created by ratchet spring 76. As described above, when ratchet 74 rotates in direction of arc B, ratchet 74 urges latch body 70 in opposite direction of arrow A, towards the unlocked position, thereby withdrawing latches 66 from tracks 48, and thereby releasing latch blocks 44. Because forward springs 60 and rearward springs 62 are stretched beyond their point of equilibrium when latch blocks 44 are in the locked position, forward springs 60 and rearward springs 62 urge latch blocks 44 towards the forward end 52 of tracks 48 when latch blocks are unlocked, thereby causing toilet seat 18 to rotate downwardly until gravity urges seat 18 to the fully closed position.

As toilet seat 18 rotates downwardly, forward springs 60 and rearward springs 62 compress beyond their point of equilibrium, thereby absorbing some of the energy associated with gravity pulling seat 18 toward the lowered position. This action dampens the descent of toilet seat 18 so that it closes without a loud noise or damage to toilet seat 18 or to toilet bowl 14.

Figure 6:
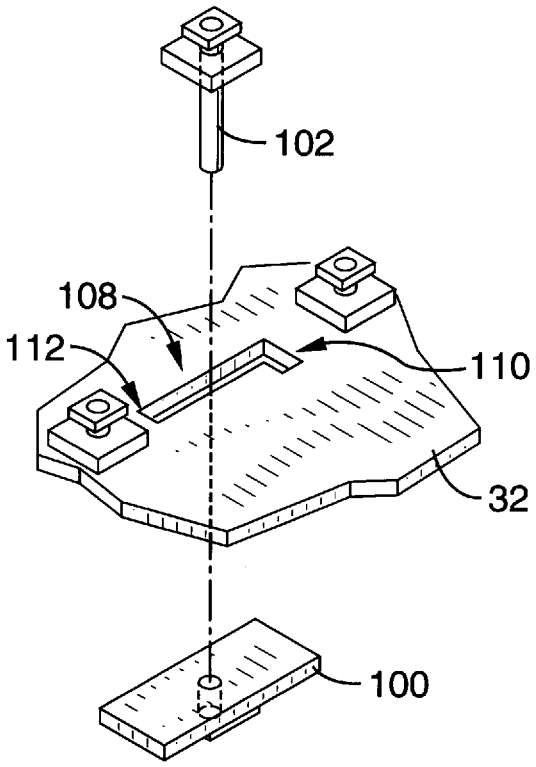
FIG. 6 is an exploded view of the override knob.

Referring more particularly to FIG. 3 and FIG. 6, an override mechanism 98 is shown. Override mechanism 98 preferably comprises an override knob 100, override post 102, release override cable 104, lock override cable 106 and override cable tensioner 114. Override knob 100 is rigidly attached to override post 102 which communicate through override slot 108 defined in lower wall 32 of housing 12. When in a deactivated state, override knob 100 maintains position generally in the middle of slot 108 where the locking and timed release of toilet seat 14 and housing 12 operate as described above. Override knob 100 and override post 102 also move between a first release override position at release override end 110 of slot 108 and a lock override position at lock override end 112 of slot 108. Release override cable 104 and lock override cable 106 are routed around posts 115, 116 and attached to override post 102 in the configuration shown in FIG. 3. Override cable tensioner 114 is attached to release override cable 104 and lock override cable 106 using a clamp 118 or the like to maintain a minimal amount of tension in release override cable 104 and lock override cable 106, also as shown in FIG. 3. Release override cable 104 has a first end attached to override post 102 and a second end attached to ratchet 74. Lock override cable 106 has a first end attached to override post 102 and a second end attached to pawl lever 80.

When a user raises toilet seat 18 to an upright position and places override knob 100 at the release override end 110 of slot 108, override post 102 creates sufficient tension in release override cable 104 to overcome the bias of ratchet 74 created by ratchet spring 76 such that ratchet 74 is maintained in the secured position, regardless of whether pawl tooth 88 has engaged ratchet 74 or not. With override knob 100 in this position, ratchet 74 is prevented from being released by wind-up motor 94, thereby maintaining latches 66 in a locked position and maintaining toilet seat 18 in an upright position indefinitely.

When a user moves override knob 100 from this position to lock override end 112 of slot 108, override post 102 removes tension in release override cable 104, thereby releasing ratchet 74 and creates sufficient tension in lock override cable 106 to rotate pawl lever 80 in direction opposite to arc C, thereby causing ratchet 74 to be released which releases latch blocks 44 from the locking end 54 of tracks 48 regardless of whether predetermined time period has elapsed.

Referring again to FIG. 1A, note that alignment plate 38 has optional upwardly extending arcuate tabs 120 that fit between lid 20 and hinges 122. The tabs help to maintain proper alignment between control unit 10 and toilet seat 18 as well as to prevent forward and rearward movement of control unit 10 in relation to the toilet seat. Also note that, while the foregoing description relates the use of dual tracks 48, control unit 10 can be constructed using a single track 48 where setting block 56 may urge ratchet 74 to engage pawl tooth 88 and to wind wind-up motor 94. This embodiment would only require one cocking arm 28. Further, those skilled in the art will appreciate that the present invention can be constructed as a retrofit for toilets as well as be integrated into a toilet seat.

Accordingly, it will be seen that this invention provides a simple mechanism for automatically lowering a toilet seat which does not require precision machining. The apparatus includes a mechanism which allows the user to override the automatic lowering of the seat to allow such a user convenient and safe access to the toilet bowl for cleaning. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An automatic toilet seat lowering apparatus, comprising:

(a) control unit means for lowering a raised toilet seat;

(b) toilet seat coupling means for coupling said control unit means to said toilet seat;

(c) toilet bowl coupling means for coupling said control unit means to a toilet bowl; and (d) a plurality of releasable latching means for maintaining said toilet seat in a raised position;

(e) said control unit means including timer means for releasing said latching means and lowering said raised toilet seat after a predetermined time period;

(f) said control unit means including manual release means for overriding said timer means and manually releasing said latching means;

(g) said control unit means including manual lockout means for overriding said timer means and preventing said latching means from being released by said timer means.

2. An apparatus as recited in claim 1, wherein said control unit means comprises energy storage means for biasing said toilet seat to a lowered position.

3. An apparatus as recited in claim 1, wherein said releasable latching means comprises:

(a) a latch body;

(b) a latch block; said latch block slidably mounted in a track, said track mounted within said control unit means;

(c) at least one latch mounted on said latch body, said latch body slidably mounted within said control unit means, said latch body slidably moving between a first locked position when said toilet seat is lowered wherein said latch extends into said track thereby ready to engage said latch block and a second unlocked position wherein said latch is withdrawn from said track and said latch block, said latch body biased towards a locked position;

(d) a ratchet member, said ratchet member pivotally mounted in said control unit, said ratchet member mechanically interfaced with said latch body, said ratchet member rotating between a first closed position where said ratchet member allows said latch body to remain in said locked position to which said latch body is mechanically biased and a second open position where said ratchet member forces said latch body towards said second unlocked position;

(e) a pawl member, said pawl member pivotally mounted within said control unit means, said pawl member mechanically interfaced with said timer means, said pawl member positioned to releasably engage said ratchet member; and (f) a setting block slidably engaging said track, said setting block mechanically interfaced with said ratchet member, said setting block slidably moving within said track between a first, secured position wherein said setting block urges said ratchet member to remain in said first closed position when said toilet seat is lowered, and a second released position when said toilet seat is raised wherein said setting block releases said ratchet member.

4. An apparatus as recited in claim 3, wherein said timer means comprises:

(a) a wind-up motor, said wind-up motor mounted in said control unit, said wind-up motor mechanically interfaced with said pawl member, said wind-up motor calibrated to clock a predetermined time period; and (b) a wind-up block, said wind-up block slidably mounted in said track, said wind-up block mechanically interfaced with said windup motor, said wind-up block slidably moving in said track from a first wound position when said seat is lowered and a second unwind position when said toilet seat is raised thereby initiating said wind-up motor.

5. An apparatus as recited in claim 1, further comprising an override knob adjustably mounted on said control unit, said override knob mechanically interfaced with said latching means, said override knob having a first position for manual release of said latching means, and a second position for preventing release of said latching means.

6. An apparatus for automatically lowering a raised toilet seat, comprising:

(a) a housing, said housing including means for coupling to a toilet seat, said housing including means for coupling to a toilet bowl, said housing mechanically biased towards a lowered position;

(b) a plurality of releasable locks mounted in said housing, said locks including means for preventing said toilet seat from returning to said lowered position when said toilet seat is lifted to a raised position;

(c) a timer, said timer mechanically interfaced with said locks, said timer including means for releasing said locks when a predetermined time period has elapsed; and (d) an override control, said override control mechanically interfaced with said locks, said override control including means for preventing said timer from releasing said locks, said override control including means for bypassing said timer and manually releasing said locks.

7. An apparatus as recited in claim 6, wherein said means for coupling said housing to said toilet bowl comprises a mounting plate and at least one cocking arm having a first and a second end, said cocking arm pivotally coupled to said mounting plate at said first end and pivotally communicating with said housing at said second end.

8. An apparatus as recited in claim 7, wherein said mechanically biased housing comprises an energy storage means.

9. An apparatus as recited in claim 8, wherein said energy storage means comprises:

(a) at least one track rigidly mounted in said housing;

(b) an energy storage device mounted in said track; and (c) a latch block slidably engaging said track, said latch block mechanically interfaced with said cocking arm at a first end and mechanically interfaced with said energy storage device also mounted in said track at a second end, said latch block slidably moving within said track between a first, cocked position when said toilet seat is raised, and a second released position when said toilet seat is lowered, where said energy storage device biases said housing towards a lowered position.

10. An apparatus as recited in claim 9, wherein said energy storage device comprises a coil spring.

11. An apparatus as recited in claim 6, wherein said lock comprises:

(a) a latch body slidably mounted in said housing;

(b) at least one latch mounted on said latch body, said latch body slidably moving between a first locked position when said toilet seat is lowered wherein said latch extends into said track thereby ready to engage said latch block and a second unlocked position wherein said latch is withdrawn from said track and said latch block, said latch body biased towards a locked position;

(c) a ratchet member, said ratchet member pivot ally mounted on said housing, said ratchet member mechanically interfaced with said latch body, said ratchet member rotating between a first closed position where said ratchet member allows said latch body to remain in said locked position to which said latch body is mechanically biased and a second open position where said ratchet member urges said latch body towards said second unlocked position;

(d) a pawl member, said pawl member pivotally mounted on said housing, said pawl member mechanically interfaced with said timer, said pawl member positioned to releasably engage said ratchet member; and (e) a setting block slidably engaging said track, said setting block mechanically interfaced with said ratchet member, said setting block slidably moving within said track between a first, secured position wherein setting block urges said ratchet member to remain in said first closed position when said toilet seat is lowered, and a second released position when seat toilet seat is raised wherein said setting block releases said ratchet.

12. An apparatus as recited in claim 11, wherein said timer comprises:

(a) a wind-up motor, said wind-up motor mounted in said housing, said wind-up motor being mechanically interfaced with said pawl member; and (b) a wind-up block, said wind-up block slidably mounted in said track, said wind-up block mechanically interfaced with said windup motor, said wind-up block slidably moving in said track from a wound position when said seat is lowered and an unwind position when said toilet seat is raised thereby initiating said timer.

13. An apparatus for automatically lowering a toilet seat, comprising:

(a) a mounting plate, said mounting plate including means for coupling to a toilet bowl, said mounting plate including at least one cocking arm pivotally coupled thereto;

(b) a housing, said housing coupled to a lower surface of said toilet seat, said housing rotatably coupled to said mounting plate, said housing moving rotatably from an open position when said toilet seat is raised and a lowered position when said seat is lowered over the toilet bowl, said housing mechanically biased towards a lowered position;

(c) an energy storage mechanism rigidly mounted in said housing, said energy storage mechanism mechanically interfaced with said cocking arm wherein said cocking arm elongates a spring when said toilet seat is raised by a user thereby mechanically biasing said housing towards a lowered position;

(d) a releasable lock mounted in said housing, said lock comprising at least one latch which is urged into a locking position when said toilet seat is raised by a user thereby locking said toilet seat in a raised position and placing said spring in an elongated state;

(e) a timer mechanically interfaced with said lock, wherein said timer is wound when said toilet seat is lowered, wherein said timer is activated and begins clocking a predetermined time period when said toilet seat is raised by a user, said timer unlocks said lock when said predetermined time period has elapsed thereby releasing said elongated spring and allowing said housing to rotate towards a lowered position; and (f) an override mechanism mechanically interfaced with said lock, said override mechanism having a release override position where said lock is indefinitely prevented from releasing and a timer override position where said timer is bypassed and said lock is released.

14. An apparatus for automatically lowering a toilet seat, comprising:

(a) a mounting plate, said mounting plate including means for coupling to a toilet bowl, said mounting plate including a plurality of cocking arms pivotally coupled thereto;

(b) a housing, said housing coupled to a lower surface of a toilet seat, said housing rotatably coupled to said mounting plate, said housing moving rotatably from an open position when said toilet seat is raised and a lowered position when said seat is lowered over the toilet bowl;

(c) an energy storage means rigidly mounted in said housing, said energy storage means mechanically interfaced with said cocking arms wherein said cocking arms elongates a corresponding spring when said toilet seat is raised by a user thereby mechanically biasing said housing towards a lowered position;

(d) a plurality of releasable locks mounted in said housing, said locks each comprising one latch which is urged into a locking position when said toilet seat is raised by a user thereby locking said toilet seat in a raised position and placing said spring in an elongated state;

(e) a timer mechanically interfaced with said lock, wherein said timer is wound when said toilet seat is lowered, wherein said timer is activated and begins clocking a predetermined time period when said toilet seat is raised by a user, said timer unlocks said locks when said predetermined time period has elapsed thereby releasing said elongated springs and allowing said housing to rotate towards a lowered position; and (f) an override mechanism mechanically interfaced with said locks, said override mechanism having a release override position where said locks are indefinitely prevented from releasing and a timer override position where said timer is bypassed and said locks are is released.

* * * * *